US005121737A

United States Patent [19]

Yencha, III

[11] Patent Number: 5,121,737

[45] Date of Patent: * Jun. 16, 1992

[54] CONVECTION COOKING OVEN WITH ENHANCED TEMPERATURE DISTRIBUTION UNIFORMITY

[75] Inventor: Michael V. Yencha, III, Freeland, Pa.

[73] Assignee: Garland Commercial Industries, Inc., Freeland, Pa.

[ * ] Notice: The portion of the term of this patent subsequent to Sep. 19, 2006 has been disclaimed.

[21] Appl. No.: 436,433

[22] Filed: Nov. 14, 1989

[51] Int. Cl.[5] ..... F24C 3/00

[52] U.S. Cl. ..... 126/21 A; 34/225; 432/199; 432/176

[58] Field of Search ..... 126/21 A; 34/225; 432/199, 176

[56] References Cited

U.S. PATENT DOCUMENTS

| | | | |
|---|---|---|---|
| 3,324,844 | 6/1967 | Huffman | 126/21 A |
| 3,710,775 | 1/1973 | Tamada et al. | 126/21 A |
| 3,926,106 | 12/1975 | Deusing et al. | 99/447 |
| 3,991,737 | 11/1976 | Del Fabbro | 126/21 A |
| 4,108,139 | 8/1978 | Gilliom et al. | 126/21 A |
| 4,395,233 | 7/1983 | Smith et al. | 432/176 |
| 4,467,777 | 8/1984 | Weber | 126/21 A |
| 4,498,453 | 2/1985 | Ueda | 126/21 A |
| 4,516,012 | 5/1985 | Smith et al. | 219/400 |
| 4,648,377 | 3/1987 | Van Camp | 126/21 A |
| 4,671,250 | 6/1987 | Hurley | 126/21 A |
| 4,867,132 | 9/1989 | Yencha | 126/21 A |
| 5,016,606 | 5/1991 | Himmel et al. | 432/176 |

*Primary Examiner*—Carroll B. Dority

*Attorney, Agent, or Firm*—Hubbard, Thurman, Tucker & Harris

[57] ABSTRACT

A gas fired convection cooking oven is provided with an improved air delivery and heat exchange structure for creating within the oven's cooking chamber a recirculating flow of heated air to cook food items supported therein. The structure includes a combustion box adapted to receive hot products of combustion from a gas burner, and extending into the cooking chamber through a lower portion of a vertical boundary wall thereof. Removably secured to the combustion box, and extending upwardly along the inner side of the boundary wall is a hollow baffle structure having a front mixing chamber communicating with the interior of the combustion box through spaced apart hollow legs with a discharge opening formed therebetween. Perforated skirt walls extending rearwardly from the mixing chamber define with the boundary wall a fan chamber which surrounds a motor-driven centrifugal fan impeller supported on the inner side of the boundary wall. During oven operation the recirculating air flow is drawn from the cooking chamber into the mixing chamber, mixed with burner combustion products and flowed into the fan. The flow is then ejected from the fan and forced into the cooking chamber through the skirt wall perforations and through the discharge opening between the mixing chamber leg portions. Removal of the baffle structure from the combustion box and the boundary wall conveniently exposes the fan impeller within the cooking chamber for inspection, cleaning and service purposes.

8 Claims, 3 Drawing Sheets

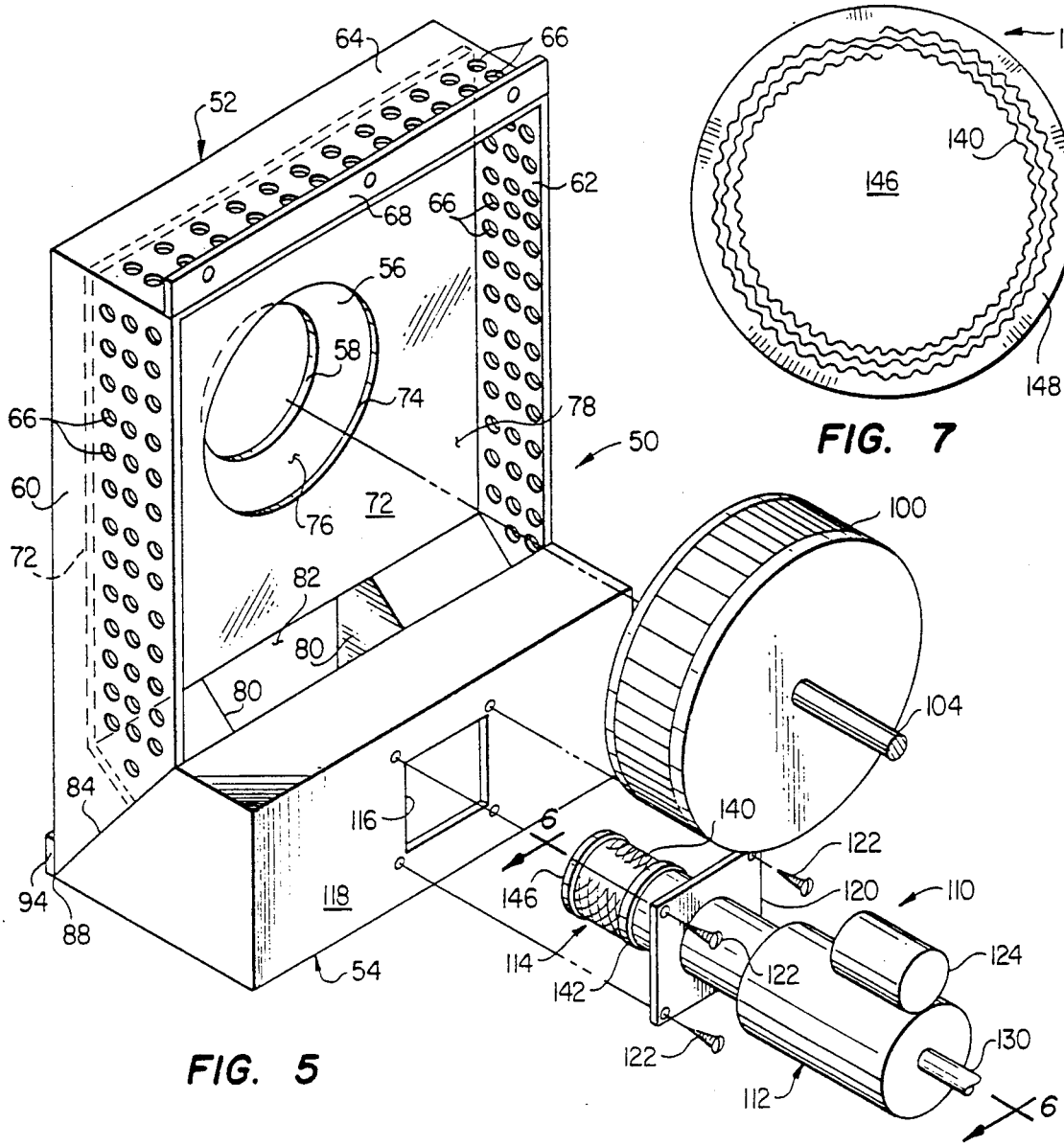
FIG. 5
FIG. 7
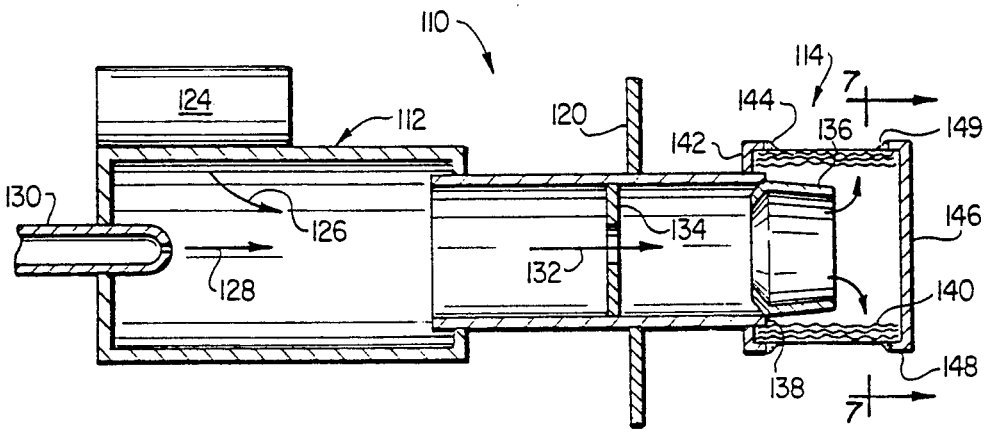
FIG. 6

CONVECTION COOKING OVEN WITH ENHANCED TEMPERATURE DISTRIBUTION UNIFORMITY

BACKGROUND OF THE INVENTION

The present invention relates generally to cooking apparatus and, in a preferred embodiment thereof, more particularly provides a gas fired convection cooking oven which is provided with an improved air delivery and heat exchange section.

Cooking ovens in which heated air is continuously recirculated through a cooking chamber, to cook food items supported therein, are commonly referred to as "convection" ovens. A motor-driven fan impeller positioned within the oven housing is typically utilized to create the recirculating air flow through the cooking chamber, and cooking heat is conventionally transferred to the recirculated air by means of a gas burner whose combustion products are flowed directly into the fan impeller and/or flowed through a heat exchanger operably interposed in the path of the recirculating air.

A conventional direct-fired convection oven of this general type is illustrated in U.S. Pat. No. 4,648,377 to Van Camp. In the Van Camp oven a centrifugal fan impeller is positioned behind a single metal baffle plate vertically secured within the oven housing and generally defining a side boundary of the cooking chamber. The baffle plate has a central return opening through which recirculating air is returned from the cooking chamber to the fan impeller inlet, and peripheral edge passages through which heated air is forced by the fan impeller into the cooking chamber.

Circumscribing the fan impeller behind the baffle plate is a bifurcated heat exchanger structure having upper and lower manifolds respectively positioned above and below the fan, and a pair of generally U-shaped flow tubes positioned on peripherally opposite sides of the impeller and interconnected between the interiors of the upper and lower manifolds.

During operation of the oven the products of combustion from a gas burner are flowed sequentially into the lower manifold, upwardly through the tubes, and into the upper manifold. Air radially discharged from the impeller is flowed outwardly across and is heated by the external surface of the heat exchanger before being forced through the baffle plate peripheral openings into the cooking chamber.

The burner combustion products entering the upper manifold are discharged therefrom through a downward extension thereof positioned between the central baffle plate opening and the impeller inlet. The discharged combustion products are mixed with return air being drawn into the impeller, thereby directly transferring residual combustion product heat to the recirculating air flow. In alternate embodiments of the Van Camp oven, the upper manifold is eliminated and the open outer ends of the flow tubes are bent inwardly to a position directly in front of the impeller inlet to discharge burner combustion products directly into the impeller inlet.

Despite the apparent heat transfer efficiency of these air delivery and heat exchange structures, they have several inherent limitations and disadvantages. For example, they are fairly complex and relatively expensive to fabricate, assemble and install, thereby increasing the overall cost of the oven. Additionally, access to the fan impeller for cleaning, repair or replacement is somewhat inconvenient because the impeller is positioned behind the baffle plate, which is secured at various locations thereon to the interior of the oven housing, and is also partially blocked by the upper manifold or, as the case may be, outer end portions of the flow tubes. Thus, an appreciable amount of disassembly, and subsequent reassembly, is required to service the fan impeller.

Other conventional gas or electrically heated convection ovens having one or more of these disadvantages and limitations are representatively illustrated in U.S. Pat. No. 3,710,775 to Tamada et al; U.S. Pat. No. 3,991,737 to Del Fabbro; U.S. Pat. No. 4,108,139 to Gilliom et al; U.S. Pat. No. 4,467,777 to Weber; and U.S. Pat. No. 4,671,250 to Hurley et al.

It is accordingly an object of the present invention to provide a gas fired convection oven having an internal air delivery and heat exchange structure which may be easily, rapidly and inexpensively fabricated, assembled and installed and provides rapid and complete access to the fan impeller from the interior of the cooking chamber.

SUMMARY OF THE INVENTION

In carrying out principles of the present invention, in accordance with a preferred embodiment thereof, an improved air delivery and heat exchange structure is incorporated in a gas fired convection cooking oven having a cooking chamber separated from a motor and burner chamber by a vertically extending boundary wall of the cooking chamber.

The air delivery and heat exchange structure functions to create within the cooking chamber a recirculating flow of heated air to cook items supported therein and comprises a combustion box having a front portion extending inwardly through a lower portion of the boundary wall into the cooking chamber. A gas burner is positioned in the motor and burner chamber and has a discharge end, formed from a cylindrical, spirally wound wire mesh material, which projects forwardly into the combustion box. Also positioned in the motor and burner chamber is a fan motor used to drive a centrifugal fan impeller supported on the boundary wall within the cooking chamber above the inwardly projecting front portion of the combustion box.

Removably secured to the front combustion box portion, and extending upwardly therefrom along the boundary wall, is a hollow baffle structure having a vertically extending front wall with a central opening therein, and interconnected perforated skirt walls extending rearwardly to the boundary wall from the top edge and vertical side edges of the front wall. A vertical dividing wall positioned within the baffle structure and having a central outlet opening therein divides the baffle structure interior into a mixing chamber positioned between the front and dividing walls, and a fan chamber which receives the fan impeller and extends between the dividing wall and the boundary wall.

At their lower ends the front and dividing walls form a spaced pair of hollow, open-ended legs which are releasably held over corresponding outlet openings in the front combustion box portion by clip means formed on the combustion box adjacent such outlet openings, the leg portions forming therebetween an outlet opening which intercommunicates the cooking and fan chambers. A flange formed on the upper skirt wall is screwed to the boundary wall to thereby releasably hold the rear edges of the skirt wall against the boundary wall.

During operation of the fan and burner, combustion products from the burner flow upwardly through the leg portions into the mixing chamber, while an air-combustion product mixture is drawn from the cooking chamber into the mixing chamber through the inlet opening in the baffle structure front wall. These two flows are drawn into the fan impeller inlet through the dividing wall outlet opening, flowed into the fan chamber through the fan impeller outlet, and then forced back into the cooking chamber through the skirt wall perforations and a flow passage defined around the side and top of the baffle structure, and through the outlet opening between the baffle structure inlet leg portions.

Removal of the baffle structure from the boundary wall and the combustion completely exposes the fan impeller within the cooking chamber, thereby providing substantially unimpeded access thereto from within the cooking chamber. Both the baffle structure and the combustion box can be easily and rather inexpensively formed from flat sheet metal stampings which are appropriately bent to form these two simple structures.

BRIEF DESCRIPTION OF THE DRAWINGS

FIG. 5 is an enlarged scale, partially exploded perspective view of an improved air delivery and heat exchange structure incorporated in the oven;

FIG. 6 is an enlarged scale, somewhat schematic cross-sectional view through the burner portion of the air delivery and heat exchange structure, taken along line 6—6 of FIG. 5; and FIG. 7 is an enlarged scale cross-sectional view through the discharge end of the burner, taken along line 7—7 of FIG. 6.

DETAILED DESCRIPTION

Figure 1:
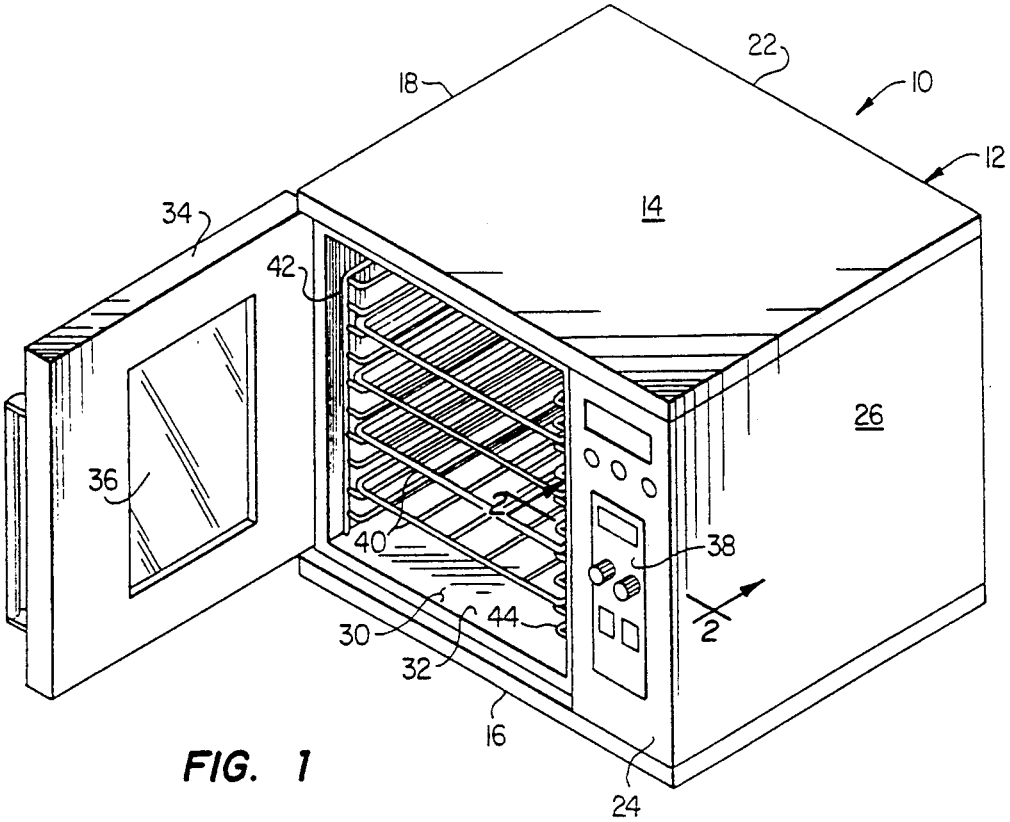
FIG. 1 is a perspective view of an improved gas fired convection oven embodying principles of the present invention.

Perspectively illustrated in FIG. 1 is an improved gas fired convection oven 10 which embodies principles of the present invention. The oven 10 is provided with a housing 12 formed for the most part from internally insulated hollow metal walls including top and bottom walls 14 and 16, a left exterior side wall 18, a right interior side wall 20 (FIG. 2), and a rear wall 22. An uninsulated right side portion 24 of the housing is provided with a side access panel 26 and defines therein a motor and burner chamber 28.

A cooking chamber 30 is positioned within the housing to the left of the insulated interior wall 20, whose inner side forms a boundary surface of the cooking chamber, and is accessible through a front housing side opening 32. A suitable access door 34 having a transparent viewing panel 36 therein is pivotally mounted on the housing to cover and uncover the access opening 32. A control panel 38 (FIG. 1) is mounted on the front side of the housing 12, to the right of the door 34, and is utilized to regulate the operation of the oven 10 in a suitable manner.

A series of metal food support racks 40 are horizontally and removably supported within the cooking chamber 30 by means of vertically extending rack support structures 42 and 44 respectively extending along the left and right interior sides of the cooking chamber. In a generally conventional manner, food items placed on the horizontal racks 40 are subjected to and cooked by a recirculating flow of heated air which traverses the cooking chamber 30 in a manner subsequently described. For purposes of illustrative clarity, the food support racks 40, and their support structures 42 and 44 have been illustrated only in FIG. 1.

Figure 2:
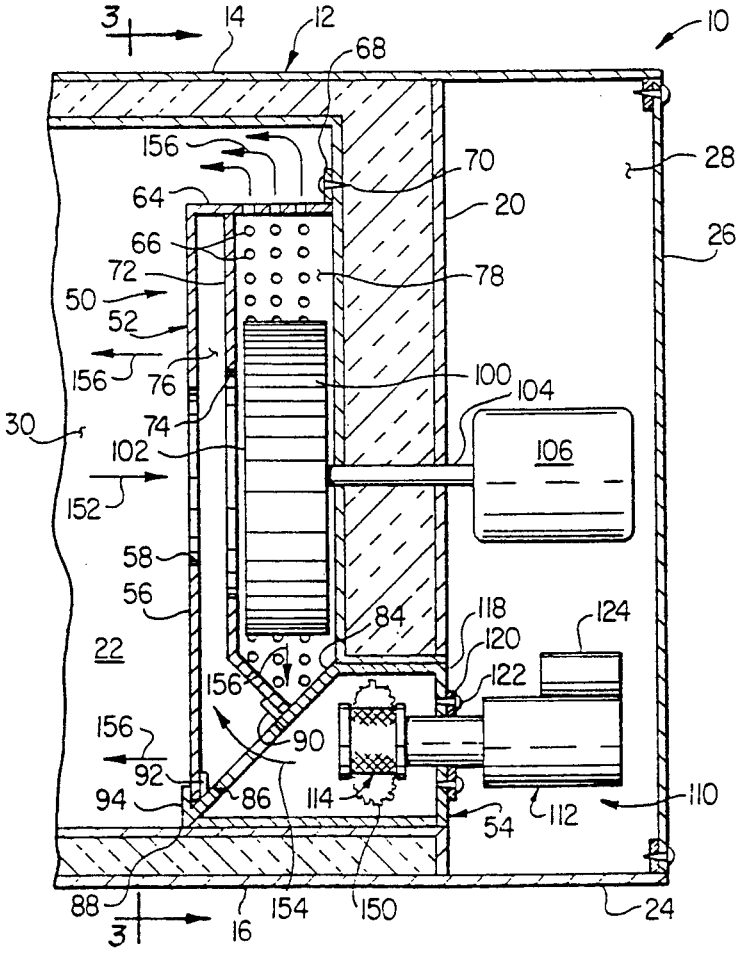
FIG. 2 is an enlarged scale partial cross-sectional view through the oven, taken along line 2—2 of FIG. 1, with the food support structure within the oven's cooking chamber removed for illustrative clarity.

Referring now to FIGS. 2–5, the present invention incorporates in the oven 10 an improved air delivery and heat exchange structure 50 which, compared to its conventional counterparts typically utilized in convection ovens of this general type, provides a variety of structural and operational advantages. Structure 50 includes a vertically extending chambered baffle portion 52 which is removably supported on and projects upwardly from a base portion 54 which rests upon the bottom housing wall 16 and, in a manner subsequently described, functions as a combustion box. As best illustrated in FIG. 2, the chambered baffle portion 52 is positioned within the cooking chamber 30 against the insulated right side interior wall 20, and the base portion 54 extends through the wall 20 into the motor and burner chamber 28.

The baffle portion 52 has a vertically elongated, generally rectangular front wall 56 having a circular opening 58 formed centrally therethrough. Extending rearwardly from the side and top edges of the front wall 56 are interconnected side and top skirt walls 60, 62 and 64, each of which has a spaced series of relatively large circular perforations 66 formed in a rear portion thereof. The rear side edges of the skirt walls 60, 62 and 64 are positioned against the insulated interior housing side wall 20 as best illustrated in FIG. 2, and the top skirt wall 64 is provided at its rear side edge with an upturned mounting flange 68 which is secured to the housing wall 20 with suitable fasteners such as screws 70 (FIG. 2).

Secured within the generally U-shaped skirt wall portion of the chambered baffle structure 52 is an interior wall 72 which is parallel to the front wall 56, and is spaced rearwardly therefrom and forwardly of the skirt wall perforations 66. A central circular opening 74 is formed in the interior wall 72 and is axially aligned with, and of a somewhat greater diameter than the opening 58 in the front wall 56. The front and rear walls 56, 72 define therebetween a vertically extending mixing chamber 76 within the baffle portion 52, while the interior wall 72 defines with the skirt walls 60, 62 and 64 and the interior housing wall 20 a considerably wider fan chamber 78 behind the mixing chamber 76. On opposite sides thereof, lower end portions of the baffle structure walls 56 and 72 form downwardly and rearwardly sloped hollow legs 80 having open lower ends. The legs 80 form therebetween a horizontally elongated rectangular opening 82 at the base of the baffle portion 52 (see FIG. 3).

Figure 3:
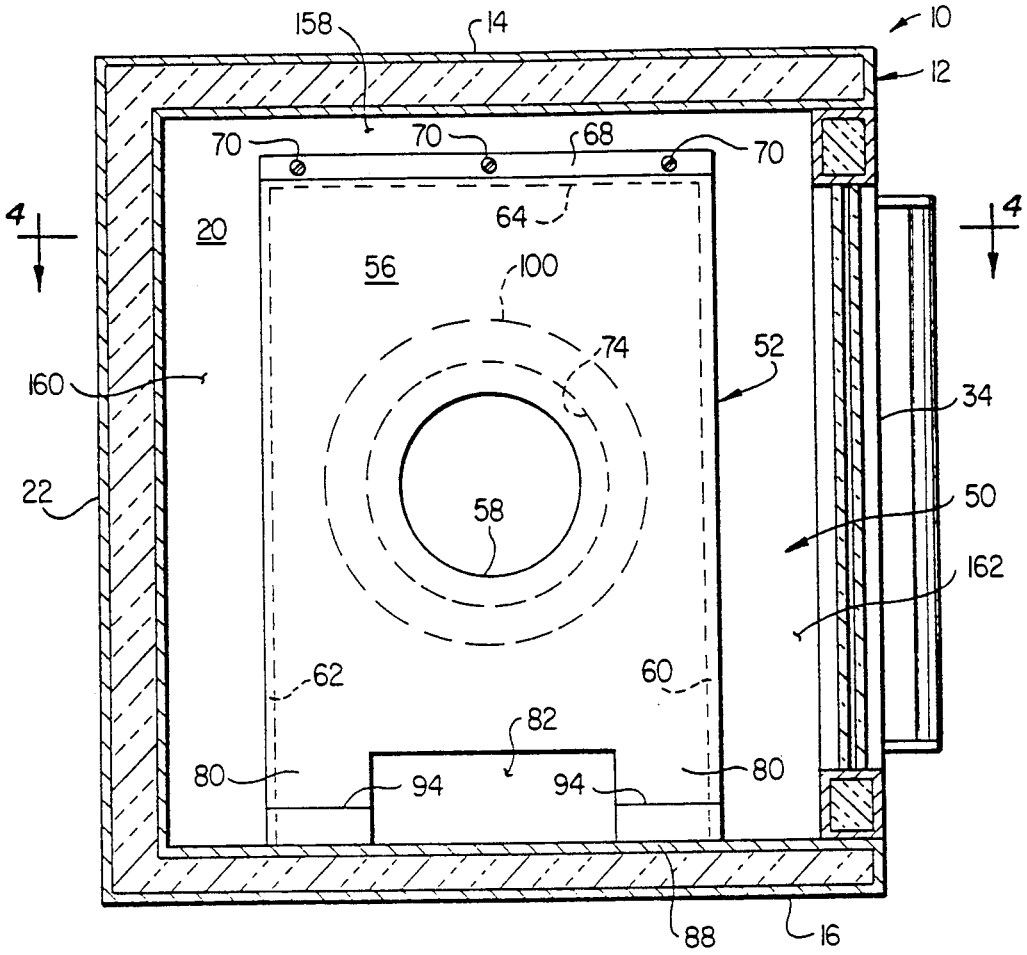
FIG. 3 is a cross-sectional view through the oven taken along line 3—3 of FIG. 2.
Figure 4:
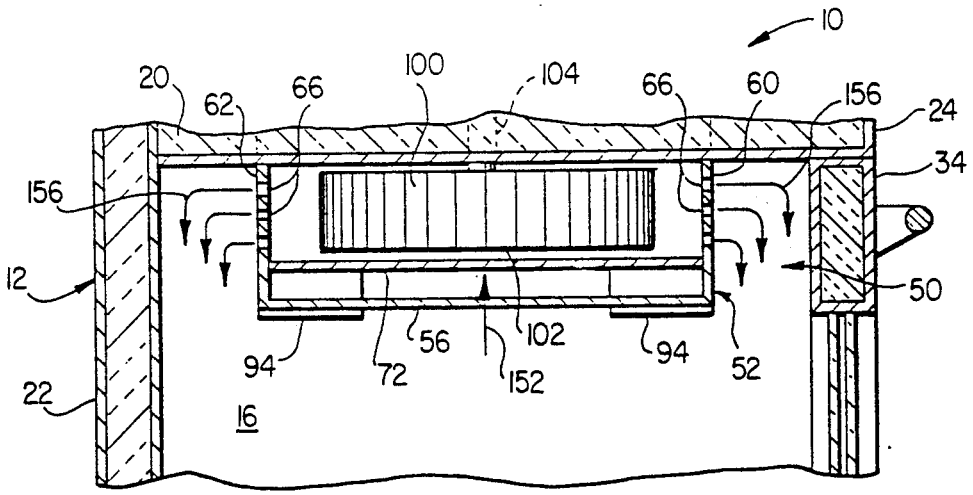
FIG. 4 is a partial cross-sectional view through the oven taken along line 4—4 of FIG. 3.

The base portion 54 of the air delivery and heat exchange structure 50 is provided with a downwardly and forwardly sloping front wall 84 having a pair of rectangular openings 86 (see FIG. 2) formed through its opposite ends adjacent its lower front side edge 88. Along the upper and lower side edges of each of the wall openings 86 a pair of outwardly projecting upper and lower alignment tabs 90 and 92 are formed, such alignment tabs being received within the open lower ends of the baffle structure legs 80 as best illustrated in FIG. 2. A pair of upturned retaining tabs 94 are formed on opposite ends of the lower front side edge 88 of the base portion front wall 84 and extend upwardly along front sides of the legs 80 as best illustrated in FIG. 3. The tabs 90, 92 and 94 function to removably support the open lower ends of the legs 80 over the wall openings 86 in the base portion 54, while the mounting flange 68 functions to removably connect an upper end portion of the chambered baffle structure 52 to the interior housing wall 20. For purposes later described, the entire chambered baffle structure 52 may be removed simply by removing the screws 70 and disengaging the legs 80 from their associated tabs 90, 92 and 94 on the base portion 54.

Operatively positioned within the fan chamber 78 is a centrifugal fan impeller 100 having an inlet 102 which is coaxial with and positioned directly behind the interior wall opening 74 of the baffle structure. The fan impeller 100 is rotationally drivable by means of a drive shaft 104 extending through the interior housing wall 20 and connected to a fan motor 106 positioned in the motor and burner chamber 28 as best illustrated in FIG. 2.

Referring now to FIGS. 2 and 5–7, the air delivery and heat exchange structure 50 also includes a gas burner 110 having a hollow, generally cylindrical body portion 112 positioned in the motor and burner chamber 28, and a discharge tip portion 114 which is inserted into the base portion 54 through a rectangular opening 116 formed in its rear wall 118. The burner 110 is supported in the chamber 28 by means of a rectangular mounting flange 120 externally welded to the burner body 112 and removably secured to the base portion rear wall 118 by screws 122. Burner 110 is of an air boosted type and has a blower 124 secured to its body 112 and adapted to force pressurized air 126 into the burner body for mixture with pressurized gaseous fuel 128 supplied to the body interior by a suitable gas supply pipe 130. The incoming air and fuel stream 126 and 128 are mixed within the burner body 112 to form a fuel-air mixture 132 that is forced forwardly through an orifice washer 134 secured within the burner body to facilitate the mixing of the incoming air and fuel. The fuel-air mixture 132 is flowed into the tip section 114 through an outlet fitting 136 secured to the inner end 138 of the burner body.

The burner tip section 114 comprises a hollow cylindrical spirally wound section 140 of metal wire mesh which is received at one end in an annular external mounting flange 142 secured to the inner end 138 of the burner body. An annular braze bead 144 is used to fixedly secure the wire section 140 to the flange 142. A circular cap member 146 having a peripheral flange 148 is fixedly secured over the opposite end of the mesh section 140 by means of a braze bead 149. During operation of the burner 110, the fuel-air mixture 132 is forced laterally outwardly through the wire mesh section 140 around its periphery, and is ignited by conventional igniter means (not illustrated) to form around the mesh section periphery a compact "blue flame" 150 positioned within the base portion 54 as illustrated in FIG. 2. The overlapping mesh construction of the section 140 provides a very economical and easily fabricated means for evenly distributing and uniformly diffusing the flame around the burner tip. However, if desired, an alternate, generally porous material (such as a porous ceramic material) could be used in place of the illustrated wire mesh.

During operation of the oven 10 a flow 152 of return air and combustion products is drawn through the front wall opening 58 into the mixing chamber 76 by operation of the fan 100, and is mixed in chamber 76 with combustion products 154 emanating from the flame 150 and flowed upwardly through the chamber 76 through the open leg portions 80 of the baffle portion 52. The return air-combustion product mixture in the chamber 76 is drawn into the fan inlet 102 through the interior wall opening 74 and is ejected radially from the fan impeller 100 into the fan chamber 78. The return air-combustion product mixture 156 forced into the fan chamber 78 is forced outwardly through the skirt wall perforations 66, and forwardly through the rectangular opening 82 between the baffle structure legs 80. The return air-combustion product mixture 156 exiting the baffle structure in this manner is then flowed outwardly into the cooking chamber 30 through the rectangular opening 82, as well as through a supply passage having top and side supply portions 158, 160 and 162 defined between the top and vertical side walls of the baffle structure 52 and the top and vertical side surfaces of the cooking chamber 30. In this manner, the air-combustion product mixture 156 is very evenly distributed throughout the cooking chamber 30 as it is recirculated therethrough and functions to cook food items operatively supported on the racks 40 within the cooking chamber. This very even cooking air distribution within the cooking chamber 30 is further enhanced by the skirt wall perforations 66 which serve to evenly diffuse the air-combustion product mixture exiting the top and vertical side wall portions of the baffle structure 52. In a conventional manner vent means (not illustrated) are provided to continuously exhaust from the cooking chamber a small portion of the air-combustion product mixture being circulated therethrough.

The portion of the flow 156 downwardly discharged from the fan 100 impinges upon the outer side surface of the base portion front wall 84 and is also flowed along the rear and vertical side surfaces of the baffle structure inlet legs 80 to thereby very efficiently receive heat from and cool these hottest portions of the overall air delivery and heat exchange structure 50.

It can readily be seen from the foregoing that the air delivery and heat exchange structure 50 of the present invention provides distinct and structural and operational advantages compared to conventional air delivery and heat exchange structures utilized in convection ovens of this general type. For example, the chambered baffle portion 52 and the base portion 54 may be easily and relatively inexpensively formed from flat sheet metal stampings which are appropriately bent and intersecured to form these two structural elements. Despite this structural simplicity, the releasably intersecured baffle and base portions 52 and 54 serve to simultaneously transfer heat to the air discharge from the fan 100 and directly flow burner combustion products into the inlet of the fan.

However, despite this very desirable and efficient dual heat transfer function provided by the baffle and base portions 54, both the fan and burner elements 100, 110 are very easily and rapidly accessible for inspection, service and maintenance. For example, complete access to the fan impeller 100 from within the cooking chamber is rapidly achieved simply by removing the screws 70 and pulling the baffle structure 52 outwardly from the base portion 54 to completely expose the fan impeller 100 within the cooking chamber 30. Rapid reassembly of the baffle and base portion 54 is easily accomplished by simply reengaging the baffle structure legs 80 with their base portion clips and reinserting the screws 70. Additionally, complete access to the fan motor 106 and the gas burner 110 is achieved simply by removing the side access panel 26.

The foregoing detailed description is to be clearly understood as being given by way of illustration and example only, the spirit and scope of the present invention being limited solely by the appended claims.

What is claimed is:

1. A convection oven comprising:

a housing having a cooking chamber therein;

blower means for recirculating a heated cooking gas within said cooking chamber to cook food items supported therein, said blower means including a centrifugal fan impeller wheel disposed adjacent a first surface portion of said cooking chamber and having a central inlet opening facing a second surface portion of said cooking chamber opposite said first surface portion;

burner means operative to discharge hot combustion gas; and plenum means disposed within said cooking chamber and having a portion positioned adjacent said impeller wheel inlet opening, said plenum means being operative, during operation of said blower and burner means, to receive a first flow of hot combustion gas from said burner means, and a second flow of recirculating heated cooking gas from said cooking chamber, and coaxially deliver said first and second gas flows to said impeller wheel inlet opening in an inlet flow pattern in which said second gas flow is outwardly circumscribed by a generally annular portion of said first gas flow, thereby essentially equalizing the hot gas dicharge temperature around the external periphery of said impeller wheel and facilitating a uniform cooking gas temperature distribution within said cooking chamber, said plenum means include a burner box structure having a burner means therein positioned within said cooking chamber beneath said impeller wheel for receiving said hot combustion gas from said burner means, and a mixing plenum portion separated from said burner box structure but connected thereto and extending upwardly from said burner box structure having a section adjacent said impeller wheel inlet opening that communicates with the second gas flow returning thereto, said mixing plenum portion being adapted to receive an upflow of hot combustion gas flow from said burner box structure and having first and second exterior walls spaced apart along the axis of said impeller wheel, said first and second exterior walls having openings formed therein which are generally coaxial with said impeller wheel inlet opening.

2. A convection oven comprising:

a housing having a cooking chamber therein;

blower means for recirculating a heated cooking gas within said cooking chamber to cook food items supported therein, said blower means including a centrifugal fan impeller wheel disposed adjacent a first surface portion of said cooking chamber and having a central inlet opening facing a second surface portion of said cooking chamber opposite said first surface portion;

burner means operative to discharge hot combustion gas; and plenum means disposed within said cooking chamber and having a portion positioned adjacent said impeller wheel inlet opening, said plenum means being operative, during operation of said blower and burner means, to receive a first flow of hot combustion gas from said burner means, and a second flow of recirculating heated cooking gas from said cooking chamber, and coaxially deliver said first and second gas flows to said impeller wheel inlet opening in an inlet flow pattern in which said second gas flow is outwardly circumscribed by a generally annular portion of said first gas flow, thereby essentially equalizing the hot gas discharge temperature around the external periphery of said impeller wheel and facilitating a uniform cooking gas temperature distribution within said cooking chamber, and wall means extending from said portion of said plenum means to said first surface portion of said cooking chamber and substantially enclosing said impeller wheel, said wall means having formed therethrough a spaced series of gas discharge openings.

3. A convection oven comprising:

a housing having a cooking chamber therein, said cooking chamber having a first surface portion, said first surface portion having a periphery from around which a peripheral surface portion of said cooking chamber extends to a periphery of a second surface portion facing and spaced apart from said first surface portion;

a burner box structure extending into said cooking chamber through said first surface portion adjacent its juncture with said peripheral surface portion, said burner box structure having an outlet disposed within said cooking chamber;

burner means extending into said burner box structure and being operative to discharge hot combustion gas into said burner box structure;

blower means for recirculating a heated cooking gas within said cooking chamber, said blower means including a centrifugal fan impeller wheel disposed within said cooking chamber adjacent said first surface portion thereof inwardly of its periphery, said impeller wheel having a central inlet opening circumscribing the rotational axis of said impeller wheel and facing said second surface portion of said cooking chamber;

plenum means connected to said burner box structure and extending inwardly therefrom, in a direction generally transverse to said rotational axis of said impeller wheel, and positioned to intercept a gas flow axially approaching said impeller wheel inlet opening, said plenum means being operative, during operation of said burner and blower means, to simultaneously receive flows of hot combustion gas from said burner box structure and recirculating cooking gas from said cooking chamber and to coaxially deliver a generally circularly cross-sectioned mixture of said gas flows to said impeller wheel inlet opening for radial discharge, as heated cooking gas, from said impeller wheel around its outer periphery, the delivered gas flow mixture having, around its axis, an essentially uniform radial temperature pattern;

whereby the gas flow mixture discharged from said impeller wheel is at an essentially constant temperature around the outer periphery of said impeller wheel.

4. The convection oven of claim 3 wherein:

said burner box structure is positioned beneath said impeller wheel, and said burner means extend through said first surface portion of said cooking chamber into said burner box structure.

5. The convection oven of claim 3 further comprising:

wall means extending peripherally between said plenum means and said first surface portion of said cooking chamber and defining with said burner box structure and said plenum means a gas discharge diffusion chamber which encloses said impeller wheel, said wall means having a spaced series of gas discharge openings formed therethrough.

6. The convection oven of claim 5 wherein:

said plenum means have a spaced apart pair of combustion gas inlet leg portions connected to said burner box structure for receiving hot combustion gas therefrom, the space between said combustion gas inlet leg portions defining an outlet passage from said gas discharge diffusion chamber.

7. A convection oven comprising:

a housing having a cooking chamber therein, said cooking chamber having a first surface portion, said first surface portion having a periphery from around which a peripheral surface portion of said cooking chamber extends to around the periphery of a second surface portion of said cooking chamber facing and spaced apart from said first surface portion;

blower means for recirculating a heated cooking gas within said cooking chamber to cook food items supported therein, said blower means including a drive motor disposed externally of said cooking chamber and operatively connected to a centrifugal fan impeller wheel disposed within said cooking chamber centrally adjacent said first surface portion and having a central inlet opening facing said second surface portion;

a spaced plurality of food support rack members disposed within said cooking chamber generally between said second surface portion and said impeller wheel;

a burner box structure extending into said cooking chamber and positioned radially outwardly of said impeller wheel, said burner box structure having a spaced pair of outlet openings positioned within said cooking chamber;

burner means operative to flow hot combustion gas into said burner box structure; and a plenum structure including:

a chambered mixing baffle portion extending from said burner box structure, in a direction generally transverse to the rotational axis of said impeller and positioned between said food support rack members and said impeller wheel, said chambered mixing baffle portion having a spaced pair of inlet leg portions connected to said burner box structure outlet openings, a first wall, a second wall spaced apart from said first wall toward said impeller wheel, said first and second walls having openings formed therethrough which are coaxial with one another and with said impeller wheel inlet opening, said chambered mixing baffle portion having a peripheral wall portion extending between said first and second walls, and spaced inwardly from said peripheral surface portion of said cooking chamber; and a skirt wall portion extending from said burner box structure and continuously between said peripheral wall portion of said chambered mixing baffle portion and said first surface portion of said cooking chamber, said skirt wall portion cooperating with said burner box structure to substantially enclose said impeller wheel, said skirt wall portion having a spaced series of gas discharge openings formed therein.

8. A method of creating within a cooking chamber of a convection oven a recirculating flow of heated cooking gas having an improved temperature distribution uniformity, said method comprising the steps of:

rotatably supporting a centrifugal fan impeller wheel in said cooking chamber adjacent a first surface portion thereof; said impeller wheel having a central impeller wheel inlet opening facing an opposite second surface portion of said cooking chamber and a generally circular discharged periphery;

rotationally driving said impeller wheel to create a radially outwardly directed gas discharge from around its entire discharge periphery;

flowing the discharged gas through said cooking chamber toward said second surface portion along a peripheral portion of said cooking chamber;

returning the discharged gas to said impeller wheel inlet opening along a central portion of said cooking chamber;

causing a flow of hot combustion gas to circumscribe and mix with the returning gas flow in a mixing chamber means prior to its entry into said impeller wheel inlet opening to form with the returning gas flow entering said impeller wheel inlet opening a heated gas mixture which essentially uniformly distributes the hot combustion gas around the periphery of said impeller wheel inlet opening to thereby essentially equalize the gas discharge temperature around said discharge periphery of said impeller wheel;

said step of causing said flow of hot combustion gas to circumscribe and mix with returning gas flow being performed by interposing said mixing chamber means in a mixing plenum structure between said impeller wheel inlet opening and the returning gas flow, flowing the combustion gas into said mixing chamber means through an opening spaced from said impeller wheel inlet opening and connected with said second location, flowing the returning gas into said mixing chamber means, and discharging the returning gas and the combustion gas from said mixing chamber means into said impeller wheel inlet opening;

creating a flow of hot combustion gas at a second location separated from said mixing chamber and drawing the flow of hot combustion gas into the mixing chamber by rotationally driving said impeller wheel;

flowing a portion of the heated gas discharged from said impeller wheel along the exterior surface of said mixing plenum structure to transfer combustion gas heat from said mixing plenum structure to said heated gas prior to its passage beyond said mixing plenum structure; and flowing a portion of the returning gas flow along the exterior surface of said mixing plenum structure to transfer combustion gas heat to said returning gas flow prior to its entry into said mixing plenum structure.

* * * * *